United States Patent [19]

Billington et al.

[11] 4,434,089

[45] Feb. 28, 1984

[54] DETERGENT COMPOSITIONS CONTAINING SULPHOSUCCINATES AND UNDEGRADED PROTEIN

[75] Inventors: Reginald Billington, Birkenhead; David J. Edge, Saughall; Peter Winterbotham, Wirral, all of England

[73] Assignee: Lever Brothers Company, New York, N.Y.

[21] Appl. No.: 400,575

[22] Filed: Jul. 22, 1982

[30] Foreign Application Priority Data

Jul. 24, 1981 [GB] United Kingdom ..... 8122832

[51] Int. Cl.[3] ..... C11D 1/83; C11D 1/12

[52] U.S. Cl. ..... 252/547; 252/548; 252/550; 252/551; 252/552; 252/554; 252/555; 252/557; 252/558; 252/DIG. 14

[58] Field of Search ..... 252/538, 557, DIG. 13, 252/DIG. 14, 354, 550, 551, 552, 554, 555, 558, 547, 548; 560/151; 424/359

[56] References Cited

U.S. PATENT DOCUMENTS

| | | | |
|---|---|---|---|
| 2,028,091 | 1/1936 | Jaeger | 560/151 |
| 3,689,419 | 9/1972 | Yueh | 252/90 |
| 3,787,337 | 1/1974 | Goodwin | 245/545 |
| 3,963,649 | 6/1976 | Spadini et al. | 252/546 |
| 4,072,632 | 2/1978 | Reed | 252/541 |
| 4,079,020 | 3/1978 | Millis et al. | 252/547 |
| 4,140,759 | 2/1979 | Mausner | 424/70 |
| 4,144,201 | 3/1979 | Winterbotham et al. | 252/547 |

FOREIGN PATENT DOCUMENTS

| | | |
|---|---|---|
| 1500775 | 10/1967 | France . |
| 1160458 | 6/1969 | United Kingdom . |
| 1429637 | 3/1976 | United Kingdom . |

OTHER PUBLICATIONS

Encyclopaedia of Polymer Science and Technology, edited by H. F. Mark and N. G. Gaylord, vol. 7, pp. 456–457 (Wiley–Interscience).

*Primary Examiner*—P. E. Willis, Jr.
*Attorney, Agent, or Firm*—Milton L. Honig; James J. Farrell

[57] ABSTRACT

The foaming performance in hard water of dishwashing detergent compositions containing dialkyl sulphosuccinates is enhanced by including in the composition a substantially water-soluble substantially undegraded protein, such as soluble casein, sodium caseinate, soluble gelatin or chicken egg albumen.

9 Claims, No Drawings

DETERGENT COMPOSITIONS CONTAINING SULPHOSUCCINATES AND UNDEGRADED PROTEIN

The present invention relates to detergent compositions especially, but not exclusively, suitable for use in dishwashing operations in both hard and soft water.

The term "dishes" as used herein means any utensils involved in food preparation or consumption which may be required to be washed to free them from food particles and other food residues, greases, proteins, starches, gums, dyes, oils and burnt organic residues.

Light-duty liquid detergent compositions such as are suitable for use in washing dishes are well known. Most of the formulations in commercial use at the present time are based on anionic synthetic detergents with or without a nonionic detergent. Many of such formulations contain a sulphonate-type anionic detergent, for example, an alkylbenzene sulphonate or an alkane sulphonate, in conjunction with a sulphate-type anionic detergent, for example, an alkyl sulphate or an alkyl ether sulphate, or a nonionic detergent, for example, an alcohol ethoxylate, an alkyl phenol ethoxylate, a mono- or diethanolamide or an amine oxide. The sulphonate material generally predominates.

Virtually all the sulphonate-type and sulphate-type anionic detergents have the disadvantage that they are deactivated to a certain extent by protein. Since protein generally constitutes from 5 to 25% of the natural soils encountered in dishwashing this can mean that the efficiency of dishwashing liquids can be seriously reduced in practice.

We have now surprisingly discovered that the foaming and cleaning performance of one class of anionic detergents, the dialkyl sulphosuccinates, in hard water conditions is actually enhanced by the presence of certain types of protein.

Accordingly the present invention provides a detergent composition suitable for dishwashing, especially hand dishwashing, which comprises at least one detergent-active dialkyl sulphosuccinate and at least one substantially water-soluble substantially undegraded protein. The detergent composition of the invention is preferably a liquid.

Detergent-active dialkyl sulphosuccinates are compounds of the formula I:

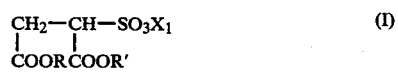

$$\begin{array}{l} CH_2-CH-SO_3X_1 \\ \quad | \qquad\;\; | \\ COOR\;COOR' \end{array} \qquad (I)$$

wherein each of R and R', which may be the same or different, is a straight-chain or branched-chain alkyl group having from 3 to 12 carbon atoms, and $X_1$ represents a solubilising cation.

By "solubilising cation" is meant any cation yielding a salt of the formula I sufficiently soluble to be detergent-active. The solubilising cation $X_1$ will generally be monovalent, for example, alkali metal, especially sodium; ammonium; or substituted ammonium, for example, ethanolamine. However, certain divalent cations, notably magnesium, are also suitable. For convenience the compounds of the formula I will be hereinafter referred to merely as dialkyl sulphosuccinates, but it is to be understood that this term is intended to refer to the salts of solubilising cations.

Dialkyl sulphosuccinates in general are known surface-active and detergent-active materials, described, for example, in U.S. Pat. No. 2,028,091 (American Cyanamid). The use of certain dialkyl sulphosuccinates in hand dishwashing compositions is disclosed, for example, in GB Pat. No. 1 429 637 (Unilever), which describes and claims such compositions containing water-soluble salts of di($C_7$–$C_9$) alkyl esters of sulphosuccinic acid in conjunction with alkyl sulphates or alkyl ether sulphates.

GB Pat. No. 1 160 485 (Colgate-Palmolive) discloses a composition comprising an inert solvent having incorporated therein a water-soluble surface-active agent and a water-soluble partially degraded protein having a gel strength of zero Blooms grams. The presence of the partially degraded protein is said to reduce irritation of the skin by the composition. The surface-active agent may be inter alia the sodium salt of dioctyl sulphosuccinate. The partially degraded protein may be a water-soluble enzymatic hydrolysis product of a protein, such as proteose peptone; or a heat-derived decomposition product of a protein.

The present invention, on the other hand, requires the use of a substantially undegraded protein. Among the undegraded proteins that may be used according to the invention, casein, albumen and gelatin are especially preferred. The proteins are used in substantially water-soluble form.

The amount of protein present is preferably within the range of from 1 to 50% by weight, based on total detergent-active material, preferably from 5 to 20% by weight.

The presence of undegraded protein in the detergent compositions of the invention has been found to increase foaming performance significantly, especially in hard water. The addition of protein to conventional dishwashing detergents based on alkylbenzene sulphonates, on the other hand, does not lead to a similar enhancement of performance. Furthermore, the addition of partially degraded proteins as disclosed in GB Pat. No. 1 160 485 to detergent compositions based on dialkyl sulphosuccinates gives no significant enhancement of performance.

The detergent composition of the invention preferably includes at least one sulphosuccinate in which at least one of the R groups has from 6 to 10 carbon atoms, more preferably from 7 to 9 carbon atoms.

Combinations of sulphosuccinates as disclosed in our co-pending Applications of even date entitled "Detergent Compositions" (Cases C.1304 and C.1304/1) are especially advantageous, as are the novel sulphosuccinates disclosed in our co-pending Application of even date entitled "Novel sulphosuccinates and detergent compositions containing them" (Case C.1305).

Even when other detergent-active materials are present the addition, according to the invention, of undegraded protein to sulphosuccinate-containing dishwashing compositions can give improved performance, for example, protein may with advantage be added, according to the present invention, to the compositions of GB Pat. No. 1,429,637 mentioned above.

Dialkyl sulphosuccinates also possess other advantages over the sulphonate-type anionic detergents conventionally used in dishwashing compositions. Alkylbenzene sulphonates and alkane sulphonates are produced by sulphonation of petrochemically derived hydrocarbons and consist of a mixture of materials of different chain lengths and sulphonate group substitution, only some of which contribute to the cleaning and foaming performance of the product, different materials being useful at different water hardnesses. The chemistry of manufacture of these materials allows at best limited control of the isomer distribution in the product alkylbenzene sulphonates and secondary alkane sulphonates.

Dialkyl sulphosuccinates, on the other hand, may be manufactured from alkanols, which are commercially available as materials of strictly defined chain length: thus the chain length of the sulphosuccinates may be precisely controlled.

Detergent compositions according to the invention may if desired contain other detergent-active agents as well as dialkyl sulphosuccinates. These are preferably anionic or nonionic, but may also be cationic, amphoteric or zwitterionic. The weight ratio of total sulphosuccinate to other detergent-active material may range, for example, from 99:1 to 1:99.

If desired, sulphosuccinates may be used in conjunction with other anionic detergents, for example, alkylbenzene sulphonates, secondary alkane sulphonates, alpha-olefin sulphonates, alkyl glyceryl ether sulphonates, primary and secondary alkyl sulphates, alkyl ether sulphates, and fatty acid ester sulphonates; or with nonionic detergents such as ethoxylated and propoxylated alcohols and ethoxylated and propoxylated alkyl phenols. These materials are well known to those skilled in the art. Materials such as amine oxides and mono- and dialkanolamides, which may be regarded either as nonionic surfactants or as foam boosters, may also be present additionally or alternatively. These materials too are well known to those skilled in the art.

Combinations of sulphosuccinates with certain other detergent-active materials, notably alkyl ether sulphates and nonionic detergents (alkoxylated alcohols) are especially preferred. The ratio of total sulphosuccinate to these other materials is preferably within the range of from 1:4 to 20:1, more preferably from 1:1 to 12:1.

Preferred alkyl ether sulphates are primary and secondary alcohol ethoxy sulphates represented by the general formula $R_1—O—(C_2H_4O)_n—SO_3M$, in which $R_1$ represents an alkyl group having 10 to 18 carbon atoms, the degree of ethoxylation n is from 1 to 12, and M represents an alkali metal, an ammonium or an amine cation. The R group more preferably contains 10 to 15 carbon atoms, and n is more preferably from 1 to 8. In any commercially available ether sulphate, there will of course be a spread of degree of ethoxylation, and n will represent an average value. An example of a suitable amine cation M is the monoethanolamine cation.

Preferred nonionic detergents are in particular the condensates of straight or branched chain primary of secondary aliphatic alcohols with ethylene oxide, of the general formula $R_2'O—(C_2H_4O)_mH$, in which $R_2$ is an alkyl group having from 8 to 20 carbon atoms, preferably from 8to 12 carbon atoms, and m, the average degree of ethoxylation, ranges from 5 to 20.

Other suitable nonionic detergents include nonionic alkylphenol polyethers of the general formula $R_3—C_6H_4—O—(C_2H_4O)_xH$, where $R_3$ is an alkyl group having from 6 to 16 carbon atoms, preferably 8 to 12 carbon atoms, and the average degree of ethoxylation x is from 8 to 16, preferably 9 to 12; and nonionic condensates of fatty acids and ethylene oxide of the general formula $R_4—CO—O—(C_2H_4O)_yH$, where $R_4$ is an alkyl group having from 12 to 18 carbon atoms, and the average degree of ethoxylation y is from 8 to 16.

As previously mentioned, the detergent compositions of the invention are preferably liquids, although dialkyl sulphosuccinates are themselves solids at ambient temperature. The detergent compositions of the invention may, however, be in any suitable physical form, for example, powders, solid bars or gels.

The sulphosuccinate materials with which the invention is concerned are however outstandingly suitable for incorporation in liquid products, with or without other detergent-active materials. These liquid detergent products may be used for all normal detergent purposes, for example, as fabric washing liquids, both built and unbuilt, for both heavy-duty laundry and for washing delicate fabrics; as personal washing products ("liquid soap"), as shampoos, as car wash products, or as foam bath products. They are, however, of especial interest in products for dishwashing, especially for hand dishwashing. These liquid products may range from concentrates, containing virtually 100% active detergent, to the more dilute aqueous solutions seen by the consumer. In the latter type of product the total amount of detergent-active material will generally range from 2 to 60% by weight, the balance being made up by water; minor ingredients such as perfume, colour, preservatives, germicides and the like; and, if necessary, a viscosity and solubility control system, referred to in the art as a hydrotrope.

The hydrotrope system, for example, may comprise any one or more of the following materials: lower alcohols, especially ethanol; urea; and lower mono- or dialkylbenzene sulphonates, such as sodium or ammonium xylene sulphonates or toluene sulphonates.

The invention is further illustrated by the following non-limiting Examples.

EXAMPLES

The dishwashing performances of various sulphosuccinate-based compositions according to the invention were compared with others without protein, by means of a modified Schlachter-Dierkes test based on the principle described in Fette und Seifen 1951, 53, 207. A 100 ml aqueous solution of each material tested, having a concentration of 0.05% active detergent, in 24° H. water (French hardness, i.e. 24 parts calcium carbonate per 100,000 parts water) at 45° C. was rapidly oscillated using a vertically oscillating perforated disc within a graduated cylinder. After the initial generation of foam, increments (0.2 g) of soil (9.5 parts commercial cooking fat, 0.25 parts oleic acid, 0.25 parts stearic acid and 10 parts wheat starch in 120 parts water) were added at 15-second intervals (10 seconds' mild agitation and 5 seconds' rest) until the foam collapsed. The result was recorded as the number of soil increments (NSI score): under the conditions used an alkylbenzene sulphonate was found to give a score of about 20 (see Example 3), and a 4:1 alkylbenzene sulphonate/alkyl ether sulphate mixture, conventional for dishwashing, gave a score of 49 (see Example 4). A score difference of 6 or less is generally regarded as insignificant. Each result was the average of 4 runs.

EXAMPLE 1

The effect of adding various amounts of soluble casein (ex Hopkins & Williams) to two different dialkyl sulphosuccinate systems was measured. The percentages of protein shown are based on the total sulphosuccinate material present.

The dialkyl sulphosuccinates used were disodium di-n-octyl sulphosuccinate and a mixture of disodium di-n-hexyl sulphosuccinate and disodium n-hexyl n-octyl sulphosuccinate. The two symmetrical sulphosuccinates were prepared as described in Example 6 of our co-pending Application of even date entitled "Detergent Compositions" (Case C.1304) and the n-hexyl n-octyl sulphosuccinate was prepared as described in Example 4 of that Application.

| Sulphosuccinate system (mole ratio where shown) | NSI scores at casein levels of | | | |
|---|---|---|---|---|
| | 0 | 1% | 5% | 20% |
| $diC_8$ | 1 | 1 | 2 | 9 |
| $diC_6 + C_6/C_8$ 1:2 | 36 | 41 | 50 | 58 |

In the case of the $diC_8$ compound which has a very poor performance at zero protein in 24° H hard water, the performance is only slightly enhanced by the presence of protein. The second system, which already gives a better than acceptable score at zero protein, gives an outstandingly good score at 1% casein, and further improvement occurs as the casein level is increased.

EXAMPLE 2

The procedure of Example 1 was repeated using soluble gelatin powder (ex British Drug Houses Ltd) instead of casein. The results were as follows:

| Sulphosuccinate system (mole ratio where shown) | NSI scores at gelatin levels of | | | |
|---|---|---|---|---|
| | 0 | 1% | 5% | 20% |
| $diC_8$ | 1 | 1 | 8 | 24 |
| $diC_6 + C_6/C_8$ 1:2 | 36 | 32 | 44 | 83 |

It will be seen that the trend is similar to that observed with casein, but that the effect at the highest protein level (20%) is larger; with gelatin at 20%, even the recalcitrant $diC_8$ compound can be brought to an acceptable performance level. The extraordinarily high score of the second system at 20% gelatin will be noted.

EXAMPLE 3

The procedure of Example 1 was repeated using a number of proteins and a number of different detergent-active systems. The proteins used were as follows:

Undegraded Proteins

Sodium caseinate ex Kerry Co-op
Gelatin powder ex British Drug Houses Ltd
Chicken egg albumen ex Sigma

Degraded Proteins

Lactalbumen enzymatic hydrolysate ex Sigma
Casein enzymatic hydrolysate ex Sigma
Proteose peptone ex Oxoid
Neutralised soya peptone ex Oxoid The results are shown in Table 1, in which the detergent-active systems used are abbreviated as follows:

ABS: linear $C_{10}$–$C_{12}$ alkylbenzene sulphonate, sodium salt (Dobs (Trade Mark) 102 ex Shell)

$diC_6+diC_8$: a 1:1 molar mixture of di-n-hexyl sulphosuccinate and di-n-octyl sulphosuccinate (sodium salts)

$C_6C_8$ pure: n-hexyl n-octyl sulphosuccinate (sodium salt), prepared as in Example 4 of our copending Application of even date (Case C1304)

$C_6C_8$ stat: a 1:2:1 molar mixture of di-n-hexyl mix sulphosuccinate, n-hexyl n-octyl sulphosuccinate and di-n-octyl sulphosuccinate (sodium salts), prepared as described in Example 1 of our copending Application of even date (Case C1304).

It will be noted that all three undegraded proteins give improved scores with the sulphosuccinate systems, the gelatin showing by far the most marked effect. With the alkylbenzene sulphonate sodium caseinate at a 5% level gives no improvement, whereas at the same level a substantial improvement is obtained with the $C_6C_8$ statistical sulphosuccinate mix. With the $diC_6/diC_8$ sulphosuccinate system a higher level of sodium caseinate (20% is required to give a substantial improvement.

The degraded proteins have very little beneficial effect on performance, and with the two $C_6/C_8$ sulphosuccinate systems proteose peptone actually has a slightly detrimental effect.

EXAMPLE 4

In this experiment the effect of adding degraded and undegraded proteins to a mixed detergent system according to the invention, and to a comparison system, was investigated. The detergent system according to the invention was a 4:1 by weight mixture of a statistical $C_6/C_8$ sulphosuccinate mixture as used in Example 3 and a linear $C_{12}$- $C_{15}$ alkyl ether (3 EO) sulphate (Dobanol (Trade Mark) 25-3A ex Shell); and the comparison composition was a 4:1 mixture of the alkylbenzene sulphonate (Dobs 102) used in Example 3 and the same alkyl ether sulphate. The undegraded protein used was sodium caseinate and the degraded protein used was proteose peptone. The results are shown on Table 2.

TABLE 1

| | NSI Scores for Detergent-active/Protein level | | | | | | | | | |
|---|---|---|---|---|---|---|---|---|---|---|
| | ABS | | $diC_6 + diC_8$ | | | | $C_6/C_8$ pure | | $C_6/C_8$ stat. mix | |
| Protein | 0 | 5 | 0 | 2 | 5 | 20 | 0 | 5 | 0 | 5 |
| Sodium Caseinate | 20 | 21 | 14 | 24 | 20 | 45 | — | — | 62 | 81 |
| Gelatin Powder | — | — | 13 | 43 | 55 | 73 | — | — | — | — |
| Chicken egg Albumen | — | — | 14 | — | 27 | 36 | — | — | — | — |
| Lactalbumen Hydrolysate | — | — | 14 | — | 20 | 22 | — | — | — | — |
| Casein Hydrolysate | — | — | 14 | — | 18 | — | — | — | — | — |
| Proteose Peptone | 21 | 22 | 13 | — | 21 | 22 | 62 | 55 | 61 | 58 |
| Neutralised Soya peptone | — | — | 14 | — | 20 | 28 | — | — | — | — |

TABLE 2

| | $C_6/C_8$ stat mix | | ABS | |
|---|---|---|---|---|
| Protein | 0 | 5% | 0 | 5% |
| Sodium Caseinate | 66 | 83 | 49 | 54 |
| Proteose Peptone | 66 | 66 | 49 | 50 |

Only the combination of sulphosuccinate and sodium caseinate shows a significant performance enhancement.

We claim:

1. A detergent composition suitable for dishwashing, which comprises:

(a) from 2 to 60% by weight of at least one detergent-active dialkyl sulphosuccinate of the formula I:

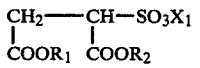

$$\begin{array}{l} CH_2 — CH — SO_3X_1 \\ \quad | \qquad\quad | \\ COOR_1 \quad COOR_2 \end{array} \qquad (I)$$

wherein each of $R_1$ and $R_2$, which may be the same or different, is straight-chain or branched chain alkyl group having from 3 to 12 carbon atoms, and $X_1$ represents a solubilising cation; and (b) from 5 to 20% by weight, based on total detergent-active material present of at least one substantially water-soluble substantially undegraded protein.

2. The detergent composition of claim 1, which includes at least one dialkyl sulphosuccinate of the formula I in which at least one of the groups $R_1$ and $R_2$ has from 6 to 10 carbon atoms.

3. The detergent composition of claim 1, which includes at least one dialkyl sulphosuccinate of the formula I in which at least one of the groups $R_1$ and $R_2$ has from 7 to 9 carbon atoms.

4. The detergent composition of claim 1, wherein the protein is selected from the group consisting of soluble casein, sodium caseinate, soluble gelatin and chicken egg albumen.

5. The detergent composition of claim 1, which additionally contains at least one anionic and/or nonionic detergent-active agent selected from the group consisting of alkylbenzene sulphonates, secondary alkyl sulphonates, αolefin sulphonates, alkyl glyceryl ether sulphonates, primary and secondary alkyl sulphates, alkyl ether sulphates, fatty acid ester sulphonates, alcohol ethoxylates and propoxylates, alkyl phenol ethoxylates and propoxylates, alkyl amine oxides, and fatty acid mono- and dialkanolamides.

6. The detergent composition of claim 5, wherein the weight ratio of total sulphosuccinate to other detergent-active material is within the range of from 1:4 to 20:1.

7. The detergent composition of claim 1, which is in liquid form.

8. The detergent composition of claim 7, which is in the form of an aqueous solution having a total content of detergent-active material within the range of from 2 to 60% by weight.

9. The detergent composition of claim 8, which further includes a viscosity control system comprising at least one material selected from lower alkanols, urea and lower alkylbenzene sulphonates.

* * * * *